US006080026A

United States Patent [19]

Ozawa

[11] Patent Number: 6,080,026

[45] Date of Patent: Jun. 27, 2000

[54] DIRECT INJECTED PERSONAL WATERCRAFT

[75] Inventor: Shigeyuki Ozawa, Iwata, Japan

[73] Assignee: Yamaha Hatsudoki Kabushiki Kaisha, Iwata, Japan

[21] Appl. No.: 09/260,200

[22] Filed: Mar. 1, 1999

[30] Foreign Application Priority Data

Feb. 27, 1998 [JP] Japan ..... 10-046579

[51] Int. Cl.[7] ..... B63H 21/10

[52] U.S. Cl. ..... 440/88

[58] Field of Search ..... 440/1, 2, 88, 89, 440/38

[56] References Cited

U.S. PATENT DOCUMENTS

| | | | |
|---|---|---|---|
| 3,948,206 | 4/1976 | Tyler | 440/38 |
| 5,490,804 | 2/1996 | Blanchard et al. | 440/38 |
| 5,984,743 | 11/1999 | Wada et al. | 440/88 |

*Primary Examiner*—Stephen Avila
*Attorney, Agent, or Firm*—Knobbe, Martens, Olson & Bear, LLP

[57] ABSTRACT

Several embodiments of personal watercraft having direct injected, internal combustion engines that employ mechanically driven high pressure pumps. In each embodiment, the high pressure pump is driven off the engine crankshaft in such a relationship to the magneto generator or alternator drive for the engine to provide a compact yet serviceable construction.

13 Claims, 11 Drawing Sheets

DIRECT INJECTED PERSONAL WATERCRAFT

BACKGROUND OF THE INVENTION

This invention relates to a personal watercraft and more particularly to an improved direct fuel injection system for such watercraft.

Personal watercraft like other applications that employ primarily internal combustion engines as their prime movers are experiencing considerable pressure to improve not only their performance but also their exhaust emission control. This has caused the manufacturers of these types of watercraft to seriously consider direct cylinder injection for the engine.

By embodying direct cylinder injection is possible to obtain significant improvements in fuel economy and also exhaust emission control. One of the main reasons for this is that direct cylinder injection may be accompanied by stratification or lean burning operation that achieves these ends.

However, there is a significant problem in connection with applying these types of devices to personal watercraft. A personal watercraft by its very nature is quite small and the engine compartment and space for the engine and its auxiliaries is quite limited.

As is well known, personal watercraft are generally designed to be operated by a single rider operator who might carry no more than two or three additional passengers. Thus, not only is the space limited but the accessibility of the engine compartment also is limited.

When direct cylinder injection is employed, it is necessary to employ a high pressure pump in order to elevate the fuel to sufficient pressure as to offer consistent injection into the combustion chamber of the engine. That is, direct injection requires considerably higher injection pressures than manifold type of fuel injection.

Normally, this high pressure can be achieved only through the use of positive displacement pumps and these pumps generally are driven from the engine output shaft. However, the pump drive presents a significant problem in personal watercraft because of their small space availability.

It is, therefore, a principal object of this invention to provide an improved and simplified fuel injection pump drive arrangement for a personal watercraft.

It is a further object of this invention to provide an improved, simplified, and compact way in which a fuel injection pump can be driven off the engine output shaft and maintain a small compact engine and engine component layout.

SUMMARY OF THE INVENTION

This invention is adapted to be embodied in a personal watercraft having a hull that defines a rider's area that is designed to be occupied primarily by a single rider operator and no more than a few passengers. The hull provides an engine compartment in which a multi-cylinder, internal combustion engine is provided. The engine has a crankshaft that rotates about an axis and which is coupled by a transmission to a propulsion device for propelling the watercraft. The crankshaft is supported so that at least one end thereof extends outwardly of the engine body. An electrical generator is driven off an end of the crankshaft. In addition, a high pressure fuel pump is driven off of an end of the crankshaft by a drive that includes a pulley fixed to an exposed end of the crankshaft.

DETAILED DESCRIPTION OF THE PREFERRED EMBODIMENTS OF THE INVENTION

Figure 1:
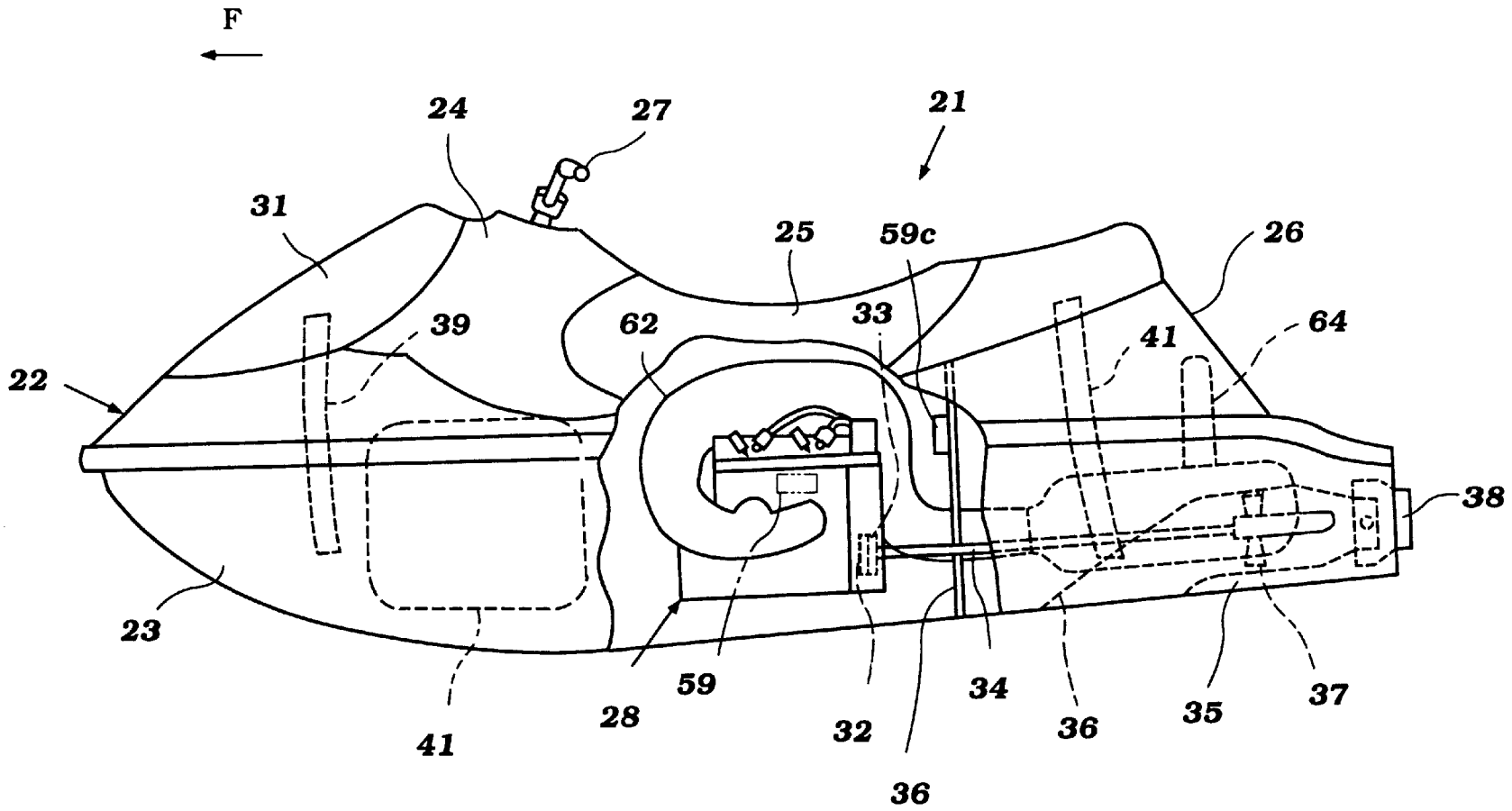
FIG. 1 is a side elevational view of a personal watercraft constructed in accordance with a first embodiment of the invention, with a portion broken away so as to more clearly show the construction.

Referring now in detail to the drawings and initially to the embodiment of FIGS. 1–4, a small personal watercraft constructed in accordance with this embodiment of the invention is identified generally by the reference numeral 21.

The watercraft 21 is comprised of a hull assembly, indicated generally by the reference numeral 22 and which is made up of a hull under part 23 and a deck part 24. The hull under part and deck part 24 are formed from a suitable material such as a molded fiberglass reinforced resin or the like and which parts are fixed together in a suitable manner.

The hull 22 defines a rider's area to the rear thereof which is comprised primarily of a seat 25 that is detachably mounted on a raised pedestal portion 26 formed centrally of the deck portion 25. A pair of foot areas 27 are formed on opposite sides of the raised portion 26 so that a rider and passengers seated on the seat 25 in straddle tandem fashion may place their feet in the foot areas 26.

As is typical with this type of watercraft, the foot areas 27 may open through the rear of the hull so as to facilitate entry and exit from the body of water in which the watercraft is operating. The seat 25 is designed to accommodate, as is noted, the rider/operator who controls the watercraft via a control mast 27 formed forwardly of the seat 25 and passengers who are seated behind the rider/operator in straddle/tandem fashion. As is typical, this type of watercraft is designed so as to accommodate the rider and no more than two or three additional passengers.

An engine compartment is formed within the hull in the area beneath the seat and an internal combustion engine, indicated generally by the reference numeral 28, is positioned within this engine compartment. As may be seen best in FIG. 3, the engine 28 is disposed so that it lies beneath an access opening 29 formed in the raised portion 26 of the deck 24. This access opening 29 is normally closed by the seat 25 or by a removable portion of it.

A storage compartment is formed in the deck 24 forwardly of the control mast 27. This storage compartment is closed by a removable closure 31.

The engine 28 is, in the illustrated embodiments, of the two-cylinder, inline type and operates on a two cycle, crankcase compression principle. It will be apparent to those skilled in the art, however, how the invention may be practiced with engines having other cylinder numbers, other cylinder configurations, and engines operating on other than a two cycle principle.

The engine 28 is mounted in the hull 22 so that its output shaft, a crankshaft 32, rotates about a longitudinally extending axis which is disposed preferably on the longitudinal centerline of the watercraft 21. This facilitates coupling via a coupling 33 which forms a portion of a transmission mechanism, to an impeller shaft 34 of a jet propulsion unit, indicated generally by the reference numeral 35. The impeller shaft 34 extends through a bulkhead 36 which defines a rearward end of the engine compartment and which lies primarily forwardly of the jet propulsion unit 35.

As is typical with this type of watercraft, the jet propulsion unit 35 is mounted primarily within a tunnel formed on the underside of the hull 22. This unit 35 includes a downwardly facing water inlet opening 36 through which water is drawn by an impeller 37 that is fixed to the rear end of the impeller shaft 34. This water is then discharged rearwardly through a discharge nozzle 38 for providing a propulsion force for the watercraft 21 as is well known in this art.

The discharge nozzle 38 may be supported for pivotal movement about a vertically moving extending steering axis or controlled by the mast 27 for steering of the watercraft. In addition, the nozzle 38 may also be pivotal about a horizontally disposed axis for trim adjustment.

Figure 2:
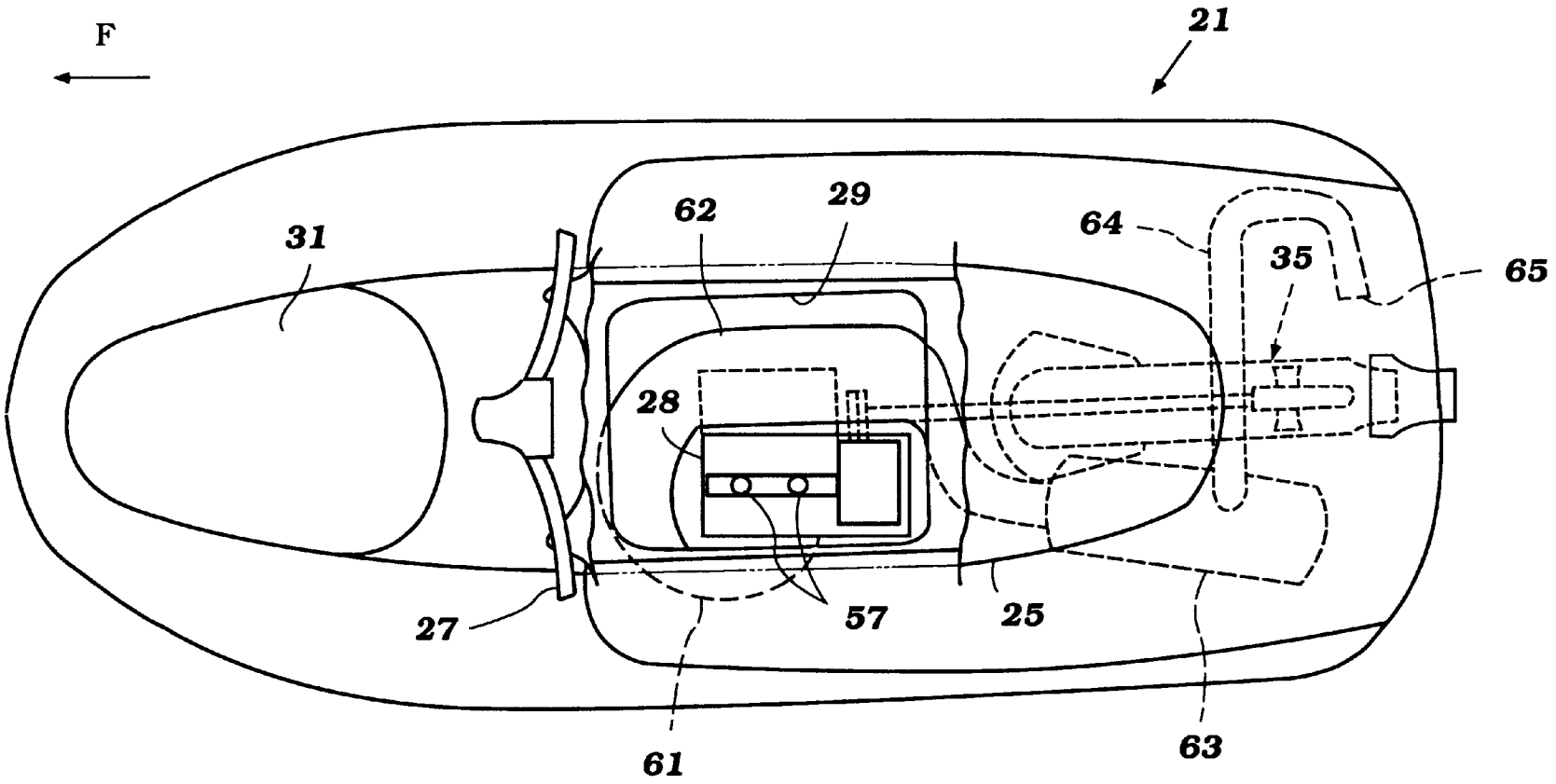
FIG. 2 is a top plan view of the watercraft shown in FIG. 1, with other portions broken away for the same purpose.
Figure 3:
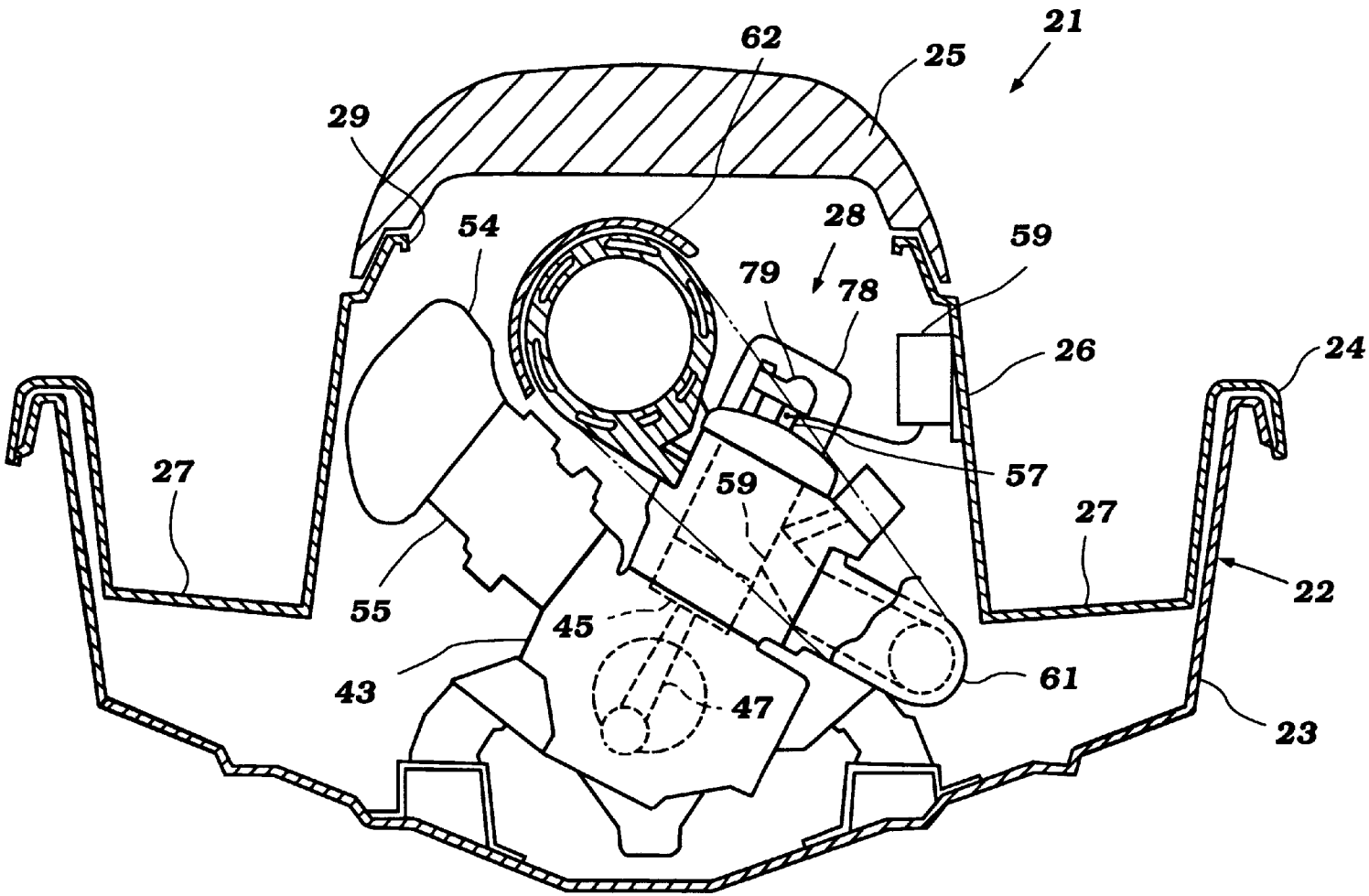
FIG. 3 is an enlarged cross-sectional view looking rearwardly and taken transversely through the watercraft.

Continuing to refer primarily to FIGS. 1–3 and before describing in detail the engine 28 and its auxiliaries, the engine compartment area is ventilated by means of a ventilating air inlet pipe 39 which enters the atmospheric air into the forward portion of the engine compartment and forwardly of a fuel tank 41 for the engine. Ventilating gases are discharged back to the atmosphere through a discharge pipe 42 that extends upwardly beneath the seat 25 and communicates with rearward portions of the engine compartment that lie on opposite sides of the tunnel containing the jet propulsion unit 35.

Figure 4:
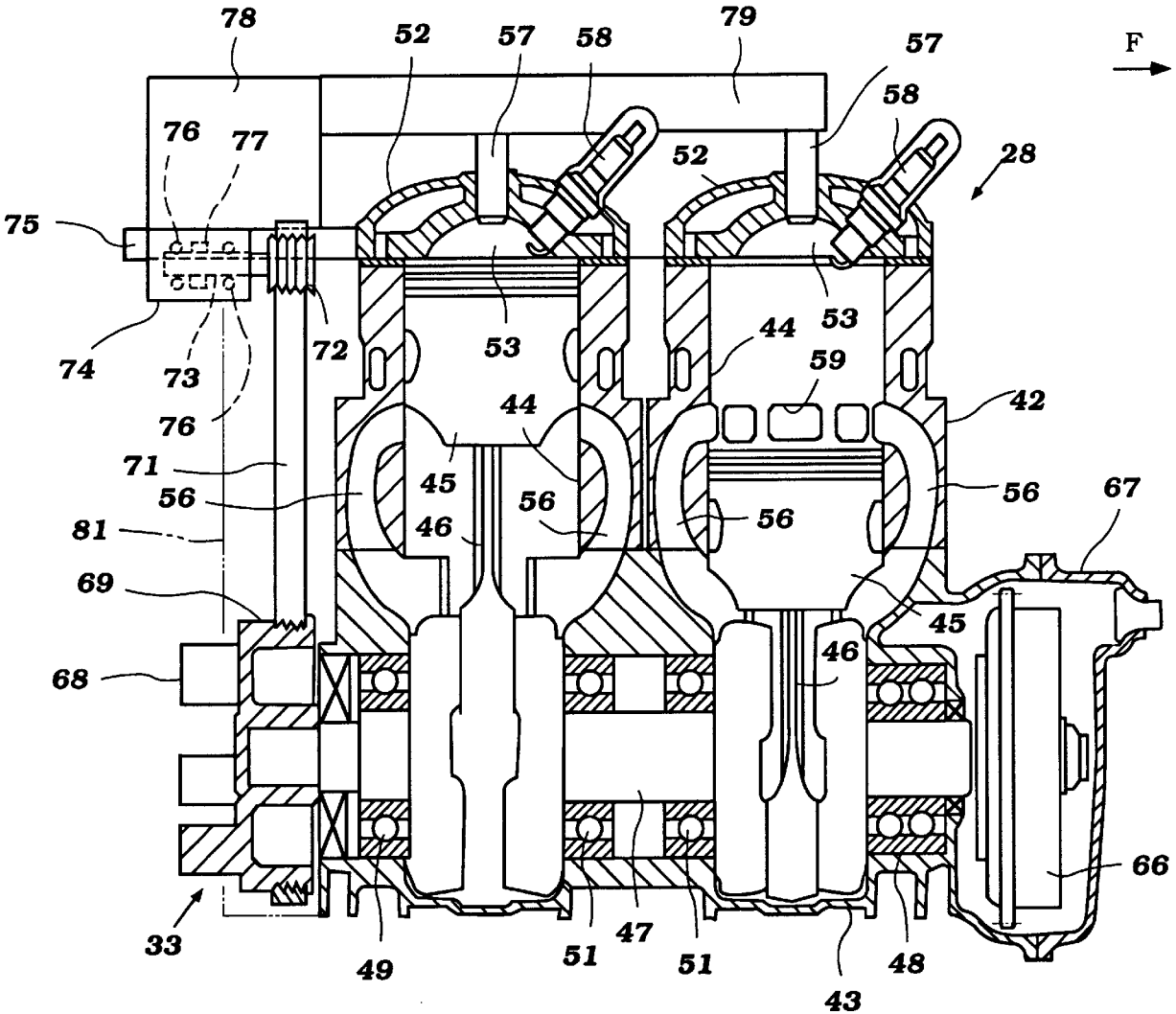
FIG. 4 is an enlarged, longitudinal cross-sectional view taken through the engine along a plane that contains the axis of the cylinder bores.

Referring now additionally to FIG. 4, the construction of the engine 28 will be described in more detail. As is has been described the engine 28 is of the two cylinder, inline type and thus is comprised of cylinder blocks 42 that are connected to a crankcase member 43 and which define a pair of cylinder bores 44. These cylinder bores 44 are inclined slightly to one side of the vertical, as seen best in FIG. 3, so as to provide a lower center of gravity and also to place the components where they may be more easily serviced.

Pistons 45 reciprocate in the cylinder bores 44 and are connected by means of connecting rods 46 to the throws of a crankshaft 47. The crankshaft 47 is rotatably journaled within the crankcase member 43 by a front main bearing 48, a rear main bearing 49, and intermediate central bearings 51. As best seen in FIG. 4, the crankshaft 47 has a length so that it protrudes beyond the bearings 48 and 49 and beyond the forward and rearward ends of the crankcase member 43.

The crankcase member 43 and the lower portions of the cylinder blocks 42 form crankcase chambers in which the crankshaft 47 rotates. As is typical with two cycle engine practice, the crankcase chamber associated with each cylinder bore 44 is sealed from the other for a reason which will become apparent shortly.

A cylinder head assembly 52 is affixed to each cylinder block 42 and has a downwardly facing recess 53 which cooperates with the heads of the pistons 45 and the cylinder bores 44 to define the combustion chambers of the engine. Because, at top dead center position of the pistons 45, the recesses 53 form the major portion of the combustion chamber, at times the reference numeral 53 will also be used to identify the combustion chambers.

An intake air charge is delivered to the crankcase chambers associated with each of the cylinder bores 44 by means of an induction system shown best in FIG. 3 and which includes an air inlet device 54 that draws air from within the engine compartment which has been supplied through the ventilating system already described. This intake charge may also be silenced by a mechanism incorporated in the inlet device 54.

This intake charge then passes through throttle bodies 55 to the crankcase chambers or specifically to intake ports formed in the crankcase member 43 which communicates with the crankcase chambers. Reed-type check valves (not shown) are positioned in the intake ports so as to permit the charge to be drawn inwardly when the piston 45 move upwardly in the cylinder bores 44.

As the pistons 45 move downwardly to compress the charge in the crankcase chambers, these check valves will close so as to preclude reverse flow. Upon the downward movement of the pistons 45, eventually scavenge ports associated at the discharge end of scavenge passages 56 will be opened and the charge is transferred to the combustion chamber 53 for further compression therein.

In accordance with a feature of the invention, fuel injectors 57 are mounted in the cylinders 52 and are disposed so as to spray directly into the cylinder head recesses 53 and combustion chambers for delivering a fuel charge which is mixed with the compressed air for combustion in the combustion chamber. Fuel is delivered to the fuel injectors 57 by a high pressure fuel supply system, which will be described shortly.

The fuel injectors 57 are preferably of the solenoid actuator type and have their solenoids controlled by the driver 59 which may be mounted at any of a plurality of appropriate locations. This may be either on one side of the hull raised portion 26 or upon the bulkhead 36 as shown at the alternate location 59*a*. Any suitable control strategy can be employed for controlling the timing and duration of injection.

The compressed fuel/air charge is fired by spark plugs 58 which are also mounted in the cylinder heads 52. When the charge is ignited by the spark plugs 58 it will burn and expand so as to drive the pistons 45 downwardly in the cylinder bores 44 and drive the crankshaft 47 in a known manner.

Eventually, the downward movement of the pistons will open exhaust ports 59. These exhaust ports 59 communicate with an exhaust manifold 61 so as to permit the exhaust gases to be discharged to the atmosphere through a system which will now be described.

The exhaust manifold 61 curves around and upwardly toward the front of the engine to communicate with an expansion chamber device 62 that lies on the other side of the engine from the exhaust manifold 61 and which is juxtaposed between the cylinder blocks 42 and the throttle bodies 55.

The expansion chamber device 62 extends rearwardly and then crosses over at the rear of the engine so as to communicate with a water trap device 63 that is disposed rearwardly in the hull on one side of the jet propulsion unit 35.

A trap pipe 64 extends upwardly from the water trap device 63 across the hull and across the upper portion of the jet propulsion unit 35 to a discharge end 65 which may communicate with the atmosphere through the tunnel in which the jet propulsion unit 35 is positioned.

It has been noted that there is an electrical control for both the fuel injectors 57 and the spark plugs 58. To provide electrical power for operating these systems, a flywheel magneto generator, indicated generally by the reference numeral 66 is fixed to the front end of the crankshaft 47 and is contained within a cover 67 fixed thereto. This flywheel magneto may be of any known type that includes generating coils for providing the requisite electrical power.

The means for supplying fuel under high pressure to the fuel injector 57 will now be described by principle reference to FIG. 4, although the structure does appear in other figures. This includes a coupling member 68 which forms a part of the transmission coupling 63 between the crankshaft 47 and the impeller shaft 34.

This coupling member 64 also is formed with an integral pulley portion 69 which drives a drive valve 71 which extends upwardly at the rearward portion of the engine 28. This drives a pump drive pulley 72 that is connected to a pump drive shaft 73 journaled within a transmission case 74 carried by an extension bracket 75 fixed to the rearward most cylinder head 52.

A pair of bearings 76 are contained within this housing 75 and journal the pump drive shaft 73. One or more cams 77 on the pump drive shaft 73 operate plungers of a high pressure pump 78 which is also mounted on the extension 75 so as to deliver fuel at sufficiently high pressure to be injected. This fuel is delivered through a fuel rail 79 to the injector 57 in a manner that is well known in the art. It should be noted that this positioning of the fuel pump 78 and fuel rail 79 places it in convenient location beneath the access opening 29 for servicing and inspection.

The drive belt 71 and pulleys 69 and 72 may be contained within a protective cover, indicated by the phantom line 81.

Figure 5:
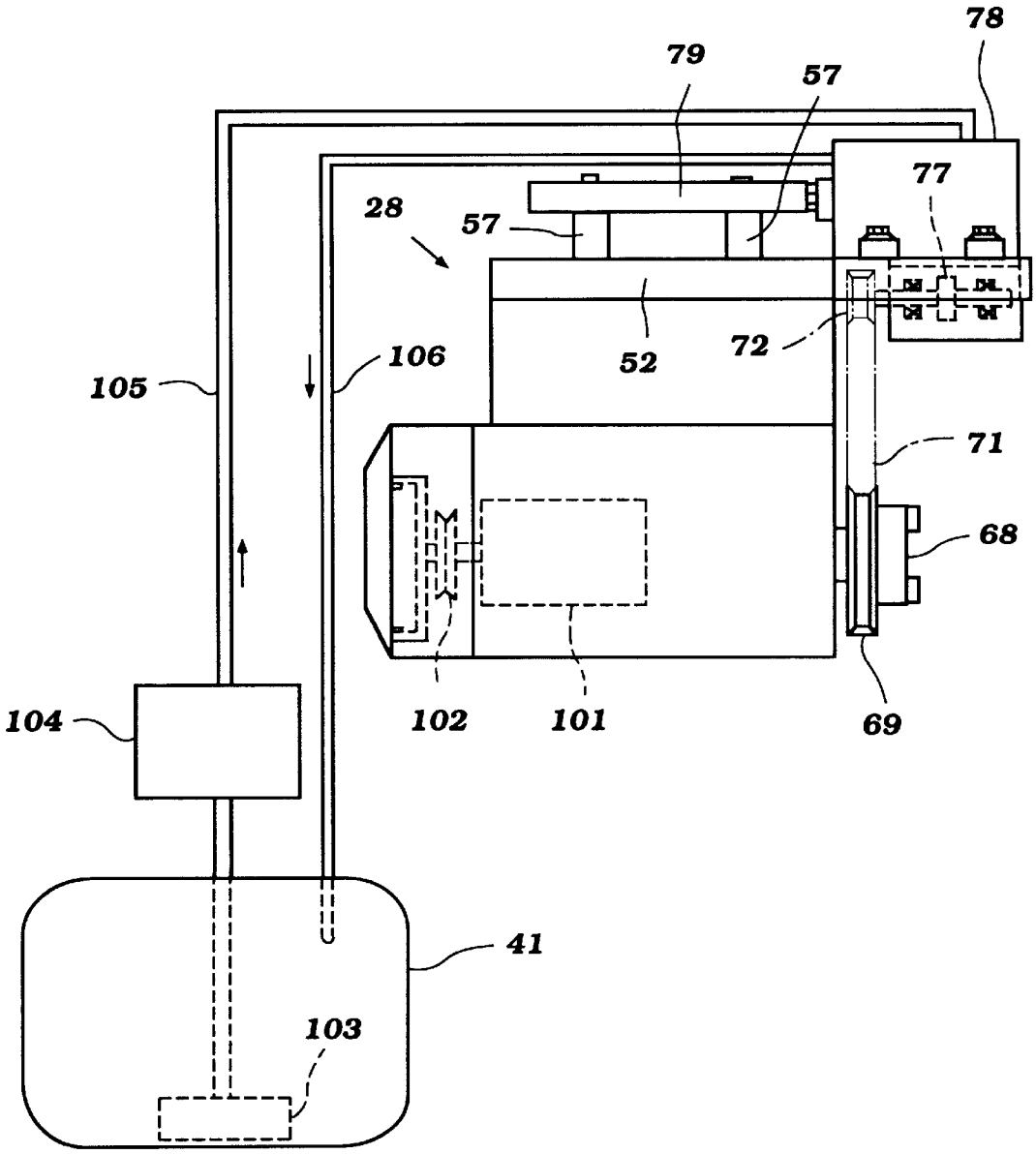
FIG. 5 is a schematic view showing another embodiment of the invention.

FIG. 5 shows another embodiment of the invention and also shows further details of the fuel supply system that may be incorporated for delivering fuel from the fuel tank 41 to the high pressure pump 78 and also for regulating the pressure. In this embodiment, however, an alternator or generator, indicated by the reference numeral 101 is mounted on a side of the engine and is driven by means of a pulley and belt 102 from the forward end of the crankshaft 47. Where components of this embodiment are the same as those previously described, they have been identified by the same reference numerals and will not be described again except insofar as is necessary to understand the construction and operation of this embodiment.

This figure also shows, as has been noted, further details of the fuel supply system which delivers fuel from the tank 41 to the high pressure pump 78 as well as the pressure regulating system that is associated with it. As may be seen, a pickup 103 is provided in the lower end of the fuel tank 41 and a low pressure pump 104 draws fuel from the tank through this pickup for delivery to a supply conduit 105. The pump 104 may be an electrically operated pump.

The high pressure pump 78 has an internal pressure regulator which regulates the pressure of fuel supplied to the fuel rail 79 by dumping excess fuel back to the fuel tank 41 through a return line 106.

Figure 6:
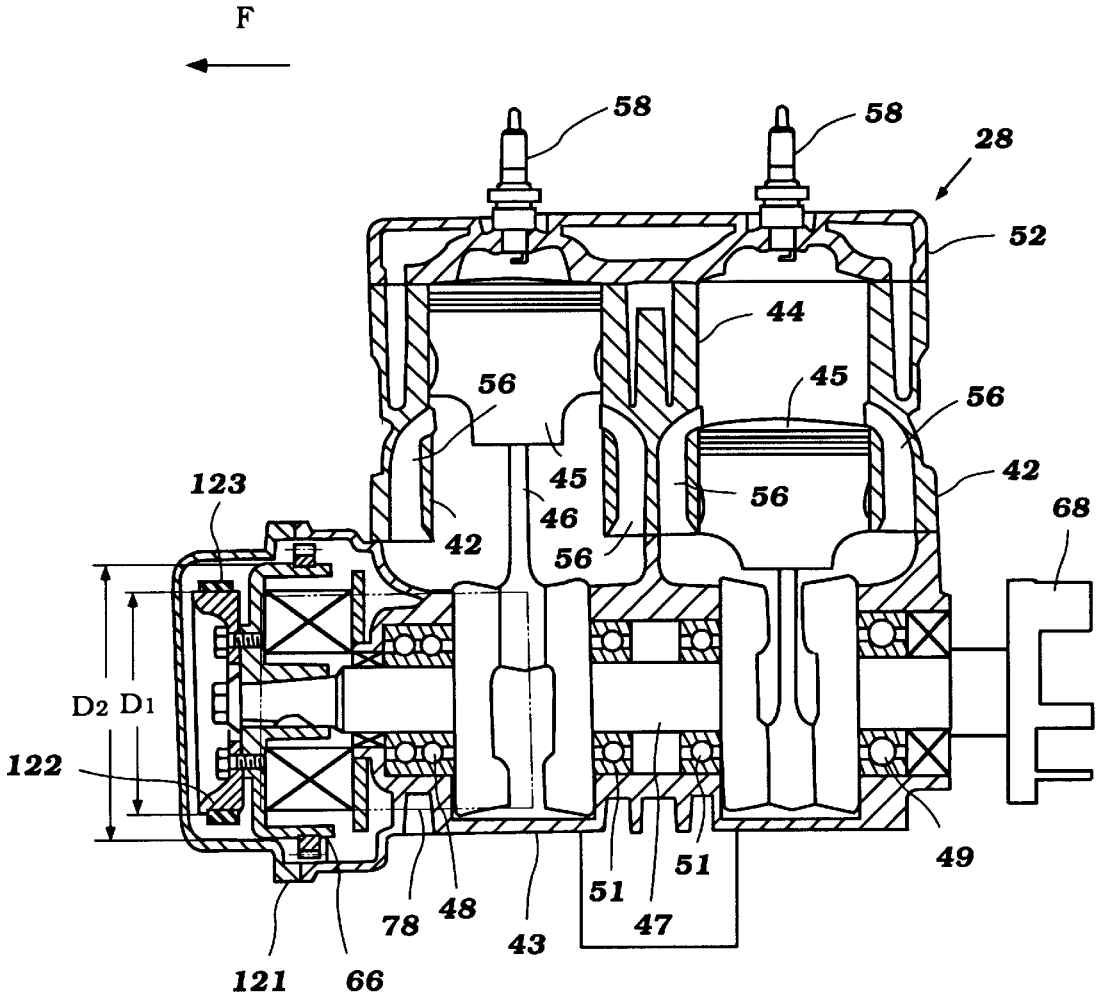
FIG. 6 is a cross-sectional view, in part similar to FIG. 4, and shows another embodiment of the invention.
Figure 7:
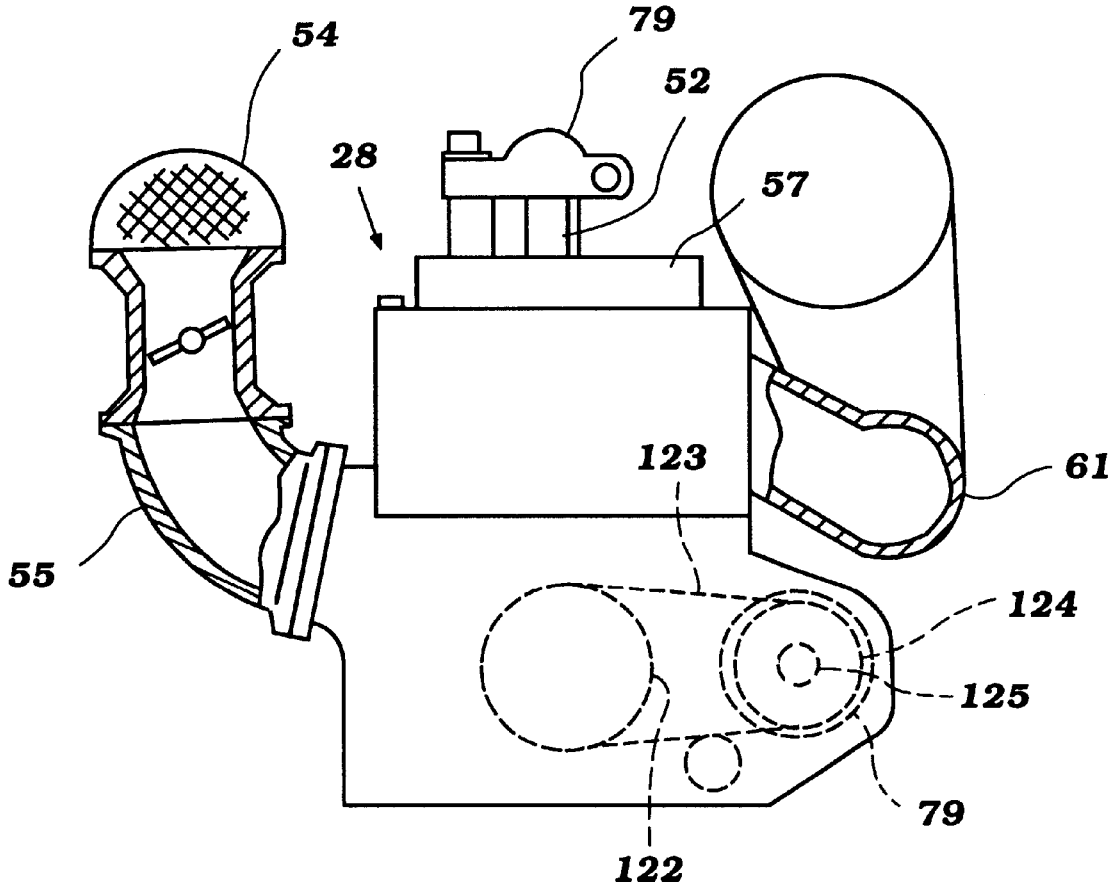
FIG. 7 is a view looking generally in the same direction as FIG. 3 but showing the embodiment of FIG. 6 and illustrates only the engine.
Figure 8:
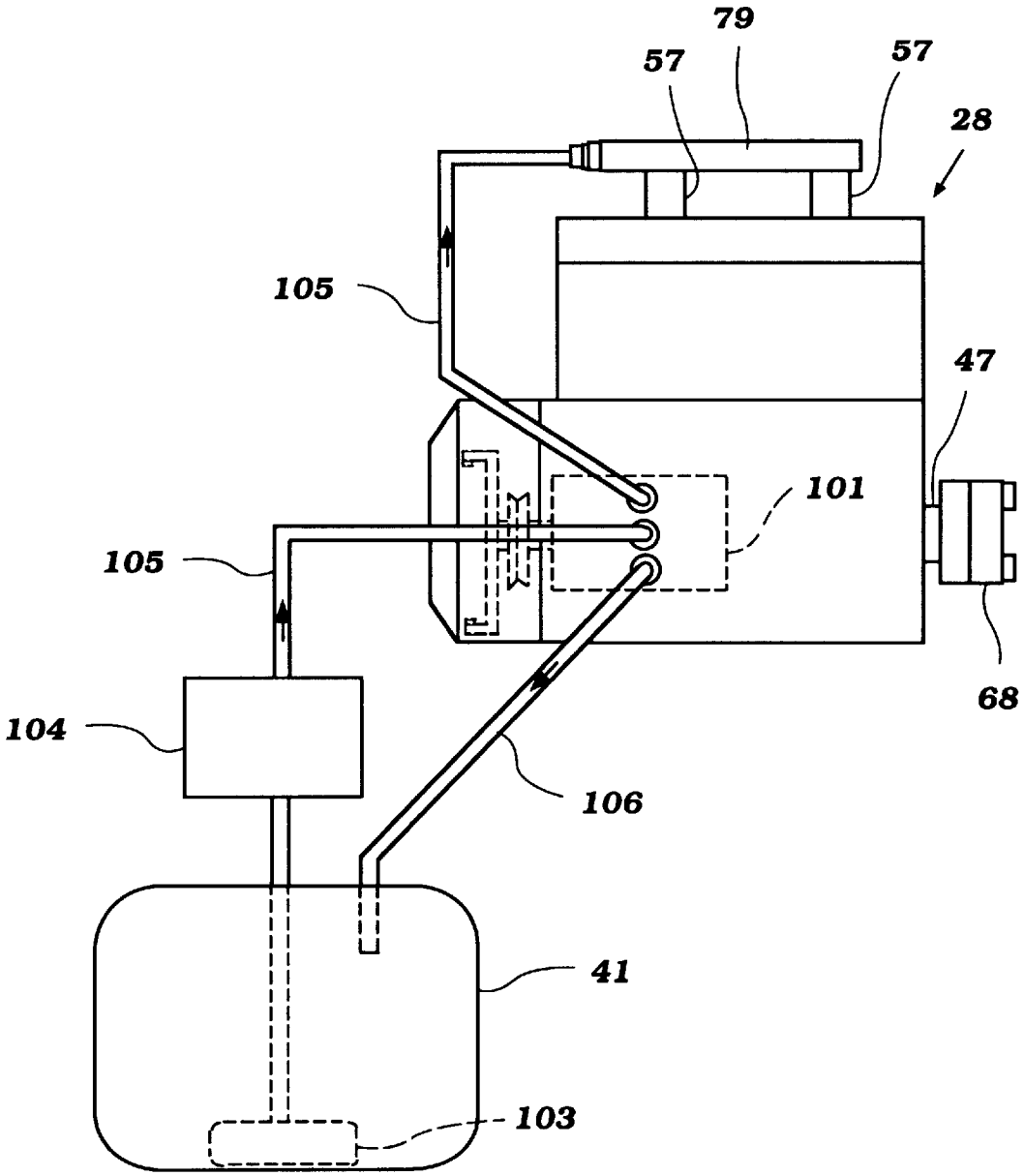
FIG. 8 is a view similar to FIG. 5 but shows the embodiment of FIGS. 6 and 7.

FIGS. 6–8 show another embodiment of this invention in which the basic components of the system are the same as those previously described. Where that is the case, those embodiments are identified by the same reference numerals and will not be discussed again in detail.

In this embodiment, however, the drive for the high pressure fuel pump 78 and the flywheel magneto 66 is at the same end of the engine. It will be seen that the flywheel magneto 66 has an outer diameter defined by a starter gear portion 121 that is larger in diameter than a pump drive pulley 122 that was fixed to the forward end of the flywheel magneto 66. This drive pulley 61 has a diameter D1 which is smaller than the diameter D2 of the outer portion of the flywheel magneto 66.

A drive belt 123 transmits drive from the drive pulley 122 to a driven pulley 124 of the drive shaft 125 of the high pressure pump 78. The high pressure pump is disposed at one side of the engine and in this particular embodiment is disposed below the exhaust manifold 61. This system also includes the pressure control system which is located in the pump and returns fuel back to the fuel tank as shown in FIG. 8 to maintain pressure regulation.

Figure 9:
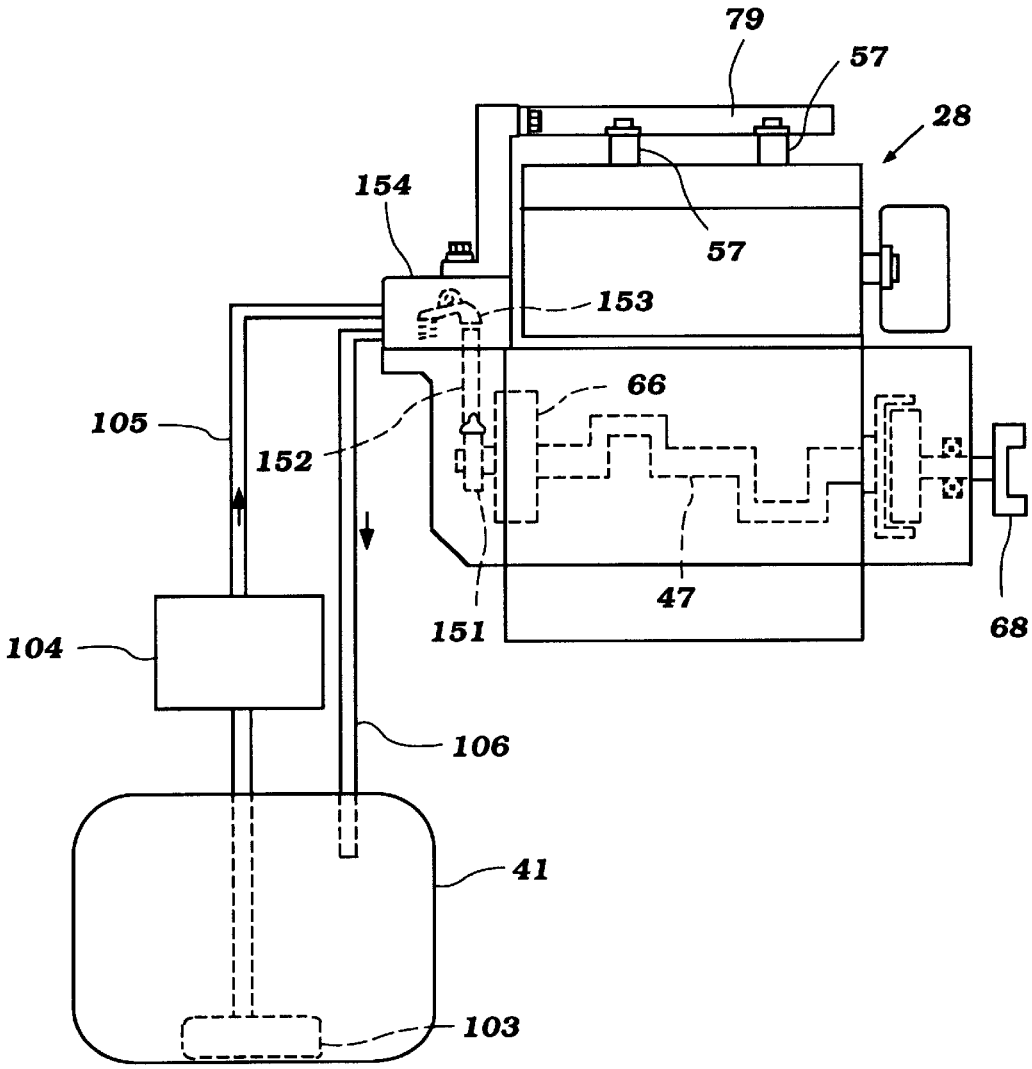
FIG. 9 is a view in part similar to FIGS. 5 and 8 and shows yet another embodiment of the invention.

FIG. 9 illustrates another embodiment which is basically the same as the first mentioned embodiment except for the type of pump drive employed. In this embodiment, a cam 151 is fixed to the front end of the crankshaft and drives a push rod 152. The push rod 152 operates a rocker arm 153 which, in turn, operates one or more pump plungers of a high pressure pump 154. This high pressure pump delivers fuel to the fuel rail 79 as previously described. Also, the pump 154 employs a pressure regulating system also of the type previously described and thus which is identified by the same reference numerals as those previously employed.

Figure 10:
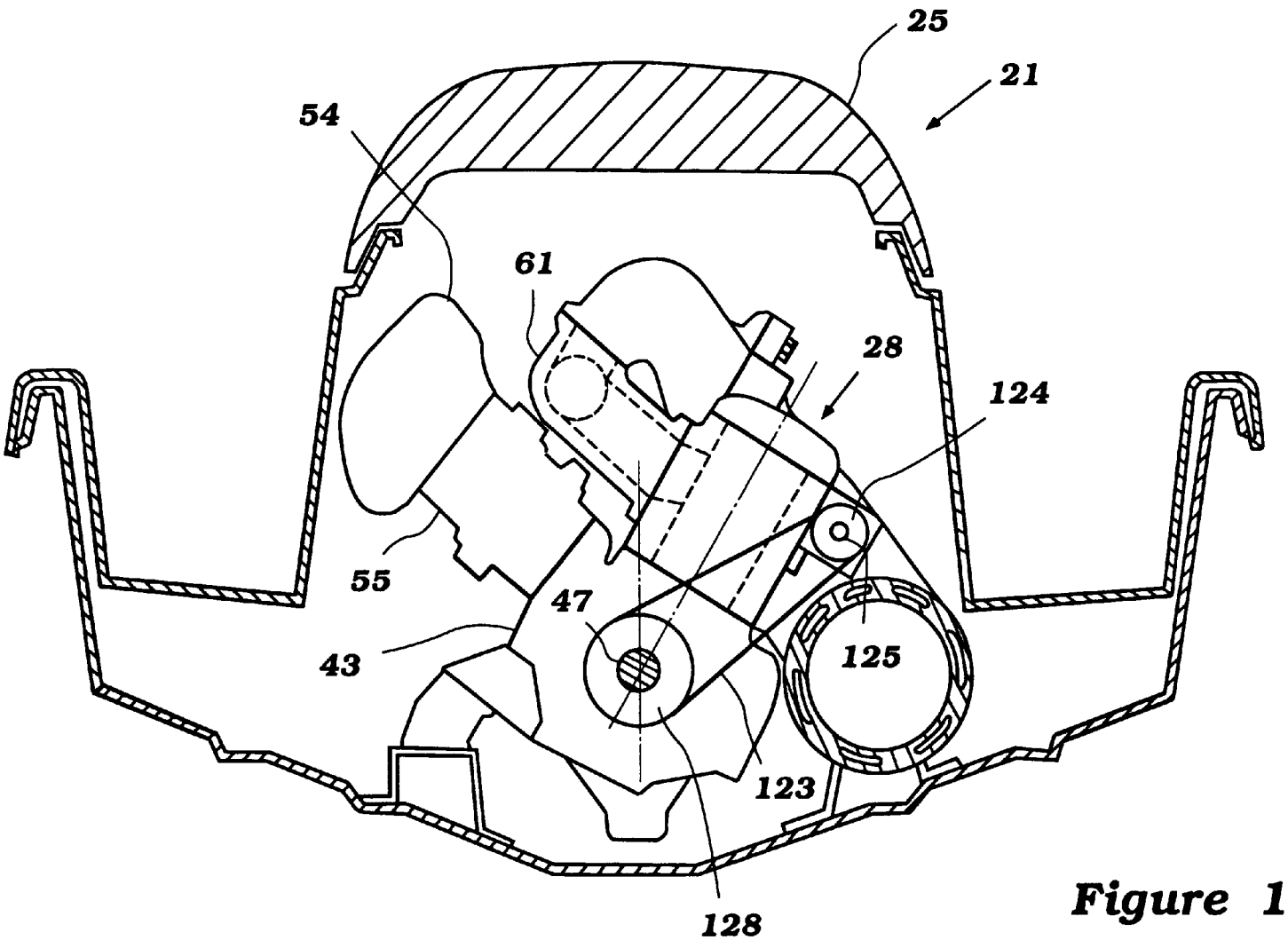
FIG. 10 is a cross-sectional view, in part similar to FIG. 3 and shows a further embodiment of the invention.

FIG. 10 shows another embodiment which is similar to the embodiment of FIGS. 6–8. In this embodiment, however, the high pressure pump is mounted on the upper side of the cylinder block as seen in FIG. 10 and the exhaust manifold is disposed on the opposite side along with the induction system. Thus, the expansion chamber device is positioned on the side where the high pressure pump is so as to maintain a compact yet readily accessible arrangement.

Figure 11:
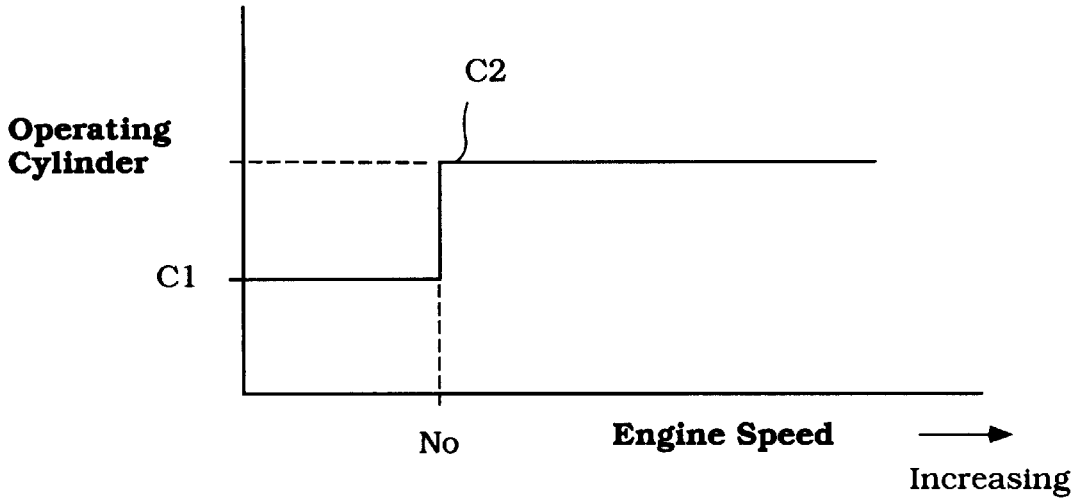
FIG. 11 is a graphical view showing how the number of operative cylinders can be changed in accordance with a further feature of the invention.

In conjunction with the use of two cycle engines, it has been the practice to operate on cylinders skipping methods so that only one cylinder is fired when the speed of the engine is below a predetermined relatively low speed. This is shown in FIG. 11 wherein when the engine speed is below this predetermined speed No the engine operates on only one cylinder. However, when the speed exceeds this speed No the engine operates with both cylinders.

Figure 12:
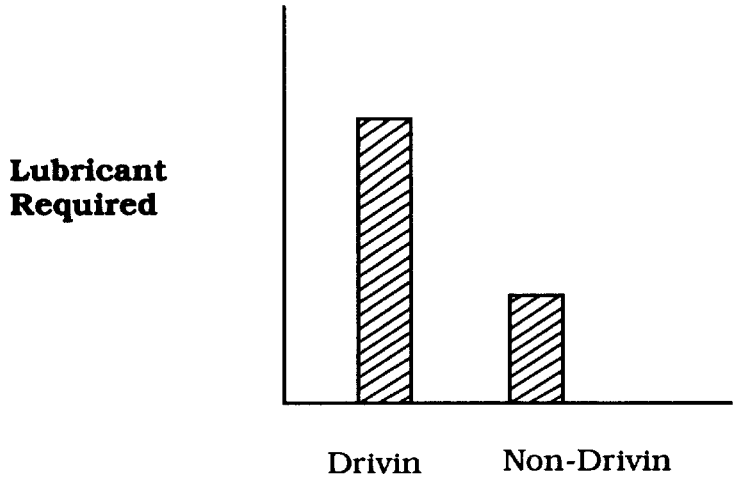
FIG. 12 is a graphical view showing the lubricant requirements for the various embodiments under different running conditions.

The engines of all of the embodiments disclosed also may be provided with separate lubricating systems and the amount of lubricant supplied can be varied in response to engine speed and operating conditions. As seen in FIG. 12, when the engine is not actually driving the watercraft, a lower amount of lubricant is supplied than when in the driving relationship. The amount of lubricant supplied during the driving relationship can be varied in any suitable manner.

Thus, from the foregoing description it should be readily apparent that there is disclosed a very effective and compact arrangement for driving the high pressure fuel pump of a direct injected personal watercraft engine that permits this accessory drive without increasing significantly the overall size of the engine package. Of course, the foregoing description is that of preferred embodiments of the invention and various changes and modifications may be made without departing from the spirit and scope of the invention as defined by the appended claims.

I claim:

1. A personal watercraft having a hull defining a rider's area configured to be occupied primarily by a single rider operator and no more than a few passengers, said hull providing an engine compartment in which a multi-cylinder, internal combustion engine is positioned, said engine having a crankshaft that rotates about an axis, a transmission coupling said crankshaft to a propulsion device for propelling said personal watercraft, said crankshaft being supported so that at least one end thereof extends outwardly of a body of said engine, an electrical generator driven off an end of said crankshaft, and a high pressure fuel pump driven off of an end of said crankshaft by a drive that includes a pulley fixed to an exposed end of said crankshaft.

2. A personal watercraft as set forth in claim 1 wherein the electrical generator and the high pressure fuel pump are driven from opposite ends of the crankshaft.

3. A personal watercraft as set forth in claim 2 wherein at least one of the electrical generator and the high pressure fuel pump are driven by a flexible transmitter.

4. A personal watercraft as set forth in claim 3 wherein the high pressure fuel pumps is driven by a flexible transmitter.

5. A personal watercraft as set forth in claim 4 wherein the electrical generator is also driven by a flexible transmitter.

6. A personal watercraft as set forth in claim 1 wherein the electrical generator and the high pressure fuel pump are driven at the same end of the crankshaft.

7. A personal watercraft as set forth in claim 6 wherein the electrical generator is disposed closer to the engine than the drive for the high pressure fuel pump.

8. A personal watercraft as set forth in claim 6 wherein the electrical generator comprises at least a flywheel magneto.

9. A personal watercraft as set forth in claim 8 wherein the high pressure fuel pump is driven by a flexible transmitter via a pulley fixed for rotation with the crankshaft.

10. A personal watercraft as set forth in claim 9 wherein the pulley for driving the high pressure fuel pump has a smaller diameter than the flywheel magneto.

11. A personal watercraft as set forth in claim 10 wherein the flywheel magneto is disposed closer to the engine than the pulley for driving the high pressure fuel pump.

12. A personal watercraft as set forth in claim 1 further including a plurality of fuel injectors for injecting fuel directly into a respective combustion chamber of the engine and wherein the high pressure fuel pump delivers fuel to said fuel injectors through a fuel rail.

13. A personal watercraft as set forth in claim 12 wherein the high pressure fuel pump and the fuel rail are a unitary assembly.

* * * * *